United States Patent [19]

Burgholte et al.

[11] Patent Number: 5,070,276

[45] Date of Patent: Dec. 3, 1991

[54] LAMP SUPPLY CIRCUIT

[75] Inventors: Alwin Burgholte; Udo Schuermann, both of Wilhemshaven; Warner Hieronimus, Rhauderfehn; Horst Horneborg, Detern, all of Fed. Rep. of Germany

[73] Assignee: Heinrich Korte, Fed. Rep. of Germany

[21] Appl. No.: 492,457

[22] Filed: Mar. 13, 1990

[30] Foreign Application Priority Data

Mar. 16, 1989 [EP] European Pat. Off. ..... 89104702.9

[51] Int. Cl.[5] ..... H05B 41/24

[52] U.S. Cl. ..... 315/209 R; 315/205; 315/210; 315/240; 315/DIG. 5

[58] Field of Search ..... 315/205, 209 R, 210, 315/240, 241 R, DIG. 5

[56] References Cited

U.S. PATENT DOCUMENTS 4,564,897 1/1986 Okamoto et al. ..... 363/132

4,904,903 2/1990 Pacholok ..... 315/209 R

FOREIGN PATENT DOCUMENTS 0253224 7/1987 European Pat. Off. .

3611611 10/1987 Fed. Rep. of Germany .

3623749 1/1988 Fed. Rep. of Germany .

3700421 7/1988 Fed. Rep. of Germany .

WO87/04891 1/1986 PCT Int'l Appl. .

*Primary Examiner*—David Mis

*Attorney, Agent, or Firm*—Lowe, Price, LeBlanc and Becker

[57] ABSTRACT

A supply circuit is proposed for high-frequency operation of one low-pressure discharge lamp or several low-pressure discharge lamps connected in parallel. The switching unit includes—a power rectifier followed by an active harmonic oscillation filter and a filter capacitor and a single-phase high-frequency generator comprising a switching transistor, a switching inductance and an oscillating capacitor, said generator being supplied from said filter capacitor and being decoupled from the power supply by means of two diodes.

15 Claims, 11 Drawing Sheets

I (A)
I
T (μsec)

U (V)
U
T (μsec)

LAMP SUPPLY CIRCUIT

BACKGROUND OF THE INVENTION

The invention relates to a supply circuit for high-frequency operation of a low-pressure discharge lamp or several low-pressure discharge lamps connected in parallel.

Connecting systems of the above kind are known per se (see German publication letters 3623749, 3611611 and 3700421). These circuitries are capable of supplying a low-pressure discharge lamp at high freuqency current and of meeting existing legal regulations with respect to mains power supplies, they do, however, still require a large number of components. The desired switching effects in the known circuitries are based on the function of a push-pull power stage in connection with at least four diodes and three capacitors.

SUMMARY OF THE INVENTION

It is the main object of the present invention to create a supply circuit for high-frequency operation of low-pressure discharge lamps, which system can do with a minimal number of components.

This object is achieved by a supply circuit for high-frequency operation of one low-pressure discharge lamp or several low-pressure discharge lamps connected in parallel. The supply circuit includes—a power rectifier followed by an active harmonic oscillation filter and a filter capacitor and a single-phase high-frequency generator comprising a switching transistor, a switching inductance and an oscillating capacitor, said generator being supplied from said filter capacitor and being decoupled from the power supply by means of two diodes.

The supply circuit according to the present invention can do with less components than the known supply circuits, because the high-frequency generator is built as single-phase high-frequency generator comprising only one switching transistor, one switching inductance, one oscillating capacitor and two diodes. By the combination of the single-phase high-frequency generator and the active harmonic oscillation filter an almost sinusoidal power current can be obtained and furthermore a lamp current and a lamp voltage result which are suitable for operating a low-pressure discharge lamp.

A preferred embodiment of the supply circuit according to the present invention is a supply circuit, wherein said active harmonic oscillation filter comprises a series inductance, a pump capacitor and two decoupling diodes, whereby the power supply current is sinusoidally modulated with a clock frequency of the lamp pulse.

The switching transistor switches the pump capacitor between the series inductance and one of the decoupling diodes against reference potential. With the harmonic oscillation filter the power current is sinusoidally modulated with every lamp pulse. With each lamp pulse an amount of energy proportional to the respective instantaneous value of the mains power is taken from the mains power during the switch-on phase and is fed to the filter capacitor through said one decoupling diode. Thereby a sinusoidally modulated power current consumption is guaranteed by the harmonic oscillation filter.

A further preferred embodiment of the present invention is a supply circuit, wherein the pump capacitor is connected to a collector or drain terminal, respectively, of the switching transistor and one of said decoupling diodes are connected in parallel to the switching inductance and the other of said decoupling diodes, wherein the increase of the voltage at the switching transistor is predetermined by the resonance characteristic determined by the switching inductance and the pump capacitor.

A further preferred embodiment of the invention is a supply circuit, wherein said single-phase high-frequency generator is operated in resonance frequency determined by the switching inductance and the oscillating capacitor. By switching the switching transistor this way, an advantageous switch-off discharge network is created.

A further preferred embodiment of the present invention is a supply circuit, wherein the pump capacitor is connected through the two decoupling diodes in parallel to the switching inducatance. Thereby, the amplitude of the negative current half-wave in the lamp is decreased, and the peak factor of the lamp current is improved.

A further preferred embodiment of the invention is a supply circuit, wherein the switching transistor is controlled by an electronic control circuit. Thereby further advantageous features may be embodied into the supply circuit.

A further preferred embodiment of the invention is a supply circuit, wherein an electronic interface is formed by the electronic control circuit.

A further preferred embodiment of the invention is a supply circuit, wherein the electronic control circuit comprises an electronic oscillator and a pulse width modulator. The electronic oscillator and the pulse width modulator can be started an stopped electronically and the pulse width and/or the frequency, respectively, thereof can be adjusted by means of an electronical control signal. This results in an interface desired for various users' options.

If the capacitance of the pump capacitor does not exceed the maximal value calculated under the formula $$C2 \leqq \frac{P(\text{total}) \cdot T(\text{mains})}{2 \cdot \sum_{\gamma=1}^{n/4} [\hat{u} \cdot \sin(\omega \cdot \gamma \cdot T(\text{lamp})) + Uo]^2} ; n = \frac{T(\text{mains})}{T(\text{lamp})}$$

wherein:

P (total) = power of the lamp

T (mains) = frequency of mains power supply

T (lamp) = frequency of the lamp current u = peak value of the mains power supply voltage $\omega$ = frequency $U_O$ = DC voltage at the capacitor $C_0$ (filter capacitor).

it is guaranteed that the power taken from the mains is consumed by the lamp output and switching losses in the lamp generator. Thus, an excessive energy storage and thus an inadmissibly high value of the voltage at the filter capacitor are avoided.

A further preferred embodiment of the invention is a supply circuit, wherein said switching inductance has two additional secondary windings, each of which is switched to the respective heater coil by means of a thyristor depending on the lamp voltage. The two additional secondary windings serve for heating up the heating coil or coils of the electrodes. This permits starting the circuit with pre-heated electrodes and in addition offers respective security functions and the protection of excess voltage and excess currents, as such might occur e.g. upon failure of a lamp.

A further preferred embodiment of the present invention is a supply circuit, wherein with the aid of an electronic control system upon each inital starting of the circuit, the switching frequency of the single-phase high-frequency generator is increased for thereupon being continuously decreased to a nominal pulse frequency within a 1/10-second time period. With this circuit arrangement an increased heating current is at disposal at each initial switching-on of the supply circuit.

A further embodiment of the invention is a supply circuit, wherein an excess voltage at a collector or drain terminal of said switching transistor via a voltage divider and one of said decoupling diodes, as well as an excess voltage of an electronic feeding circuit via the other of said decoupling diodes are used for triggering a thyristor via a trigger diode, said thyristor deactivating a starting circuit and a control circuit of said switching transistor. In this circuit it is possible to switch off the circuitry without any danger.

A further preferred embodiment of the invention is a supply circuit, wherein for protection of the circuit against excess currents, the emitter current of the switching transistor is detected at a resistor as a voltage drop and wherein a signal corresponding to said voltage drop is fed to a control circuit switching off the switching transistor when said voltage drop reaches a predetermined value.

According to a further preferred embodiment of the supply circuit according to the present invention the voltage at the collector of the switching transistor as well as the electronic supply natural voltage in the respective value is detected and in case of a possible excess voltage is used by igniting a thyristor for short-circuiting the starting circuit and for selecting the switching transistor. Thus it is possible to switch-off the circuitry without any danger.

The potential drop at the resistor causes the switching transistor to be switched off in case of excess currents and thus prevents the current from overloading. The resistor is connected in series with the emitter of the switching transistor.

A further preferred embodiment of the invention is a supply circuit, wherein for protection of the circuit against excess currents, the emitter current of the switching transistor is detected at a resistor as a voltage drop and wherein a signal corresponding to said voltage drop is fed to a control circuit switching off the switching transistor when said voltage drop reaches a predetermined value. The feeding voltage for the electronic system is derived from the rectified power voltage by a protective resistor, which feeding voltage upon reaching a maximally admissible threshold value is switched-through to electronic supply voltage with a thyristor, so that said thyristor can change over to the electronic feeding circuit. By this method the initial feeding of the electronic system can be realized with minimum expenditure for time until the clock-dependant feeding circuit can take over the voltage supply.

A further preferred embodiment of the present invention is a supply circuit, wherein with each lamp pulse an alternating voltage is tapped by means of a further secondary winding on said switching inductance or on a protective inductance and is supplied through a rectifier as an electronic self-supply voltage. The further secondary winding is located either on the switching inductance or on the protective inductance, through which an alternating voltage is tapped. This alternating voltage rectified by a single-way rectifier then provides the feeding voltage.

Embodiments of the present invention will now be described with reference to the enclosed drawings. Identical parts have identical reference numerals.

LIST OF FIGURES

DETAILED ACCOUNT OF WORKING EXAMPLE OF THE INVENTION

Figure 1:
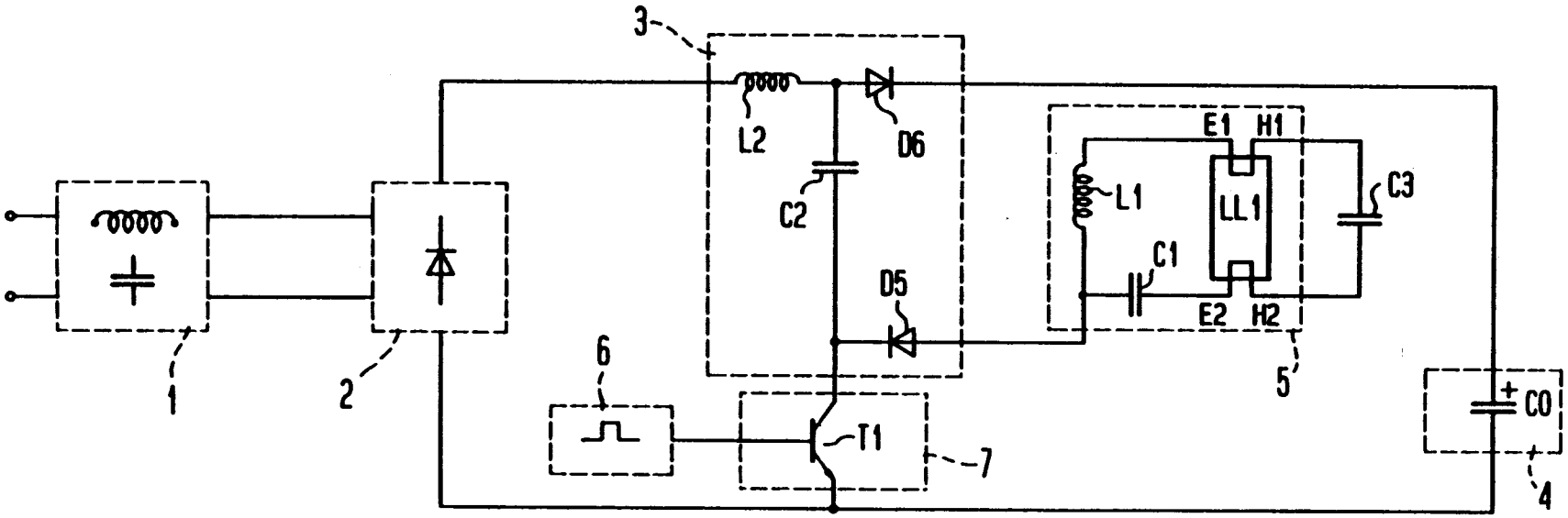
FIG. 1 is a block diagram of the supply circuit including a harmonic oscillation filter for a low-pressure discharge lamp.

The block diagram of FIG. 1 shows the principle structure of the supply circuit for high-frequency operation of a low-pressure discharge lamp LL1.

The supply circuit comprises a high-frequency filter 1, a mains rectifier 2, a single-phase high-frequency generator with a switching transistor T1 and an electronic control circuitry 6 for controlling the single-phase high-frequency generator as well as a filter capacitor 4 and an active harmonic oscillation filter 3.

The harmonic oscillation filter 3 consists of a series inductance L2, a pump capacitor C2, decoupling diodes D6 and D5 and the switching transistor T1 of the single-phase high-frequency generator.

Figure 2:
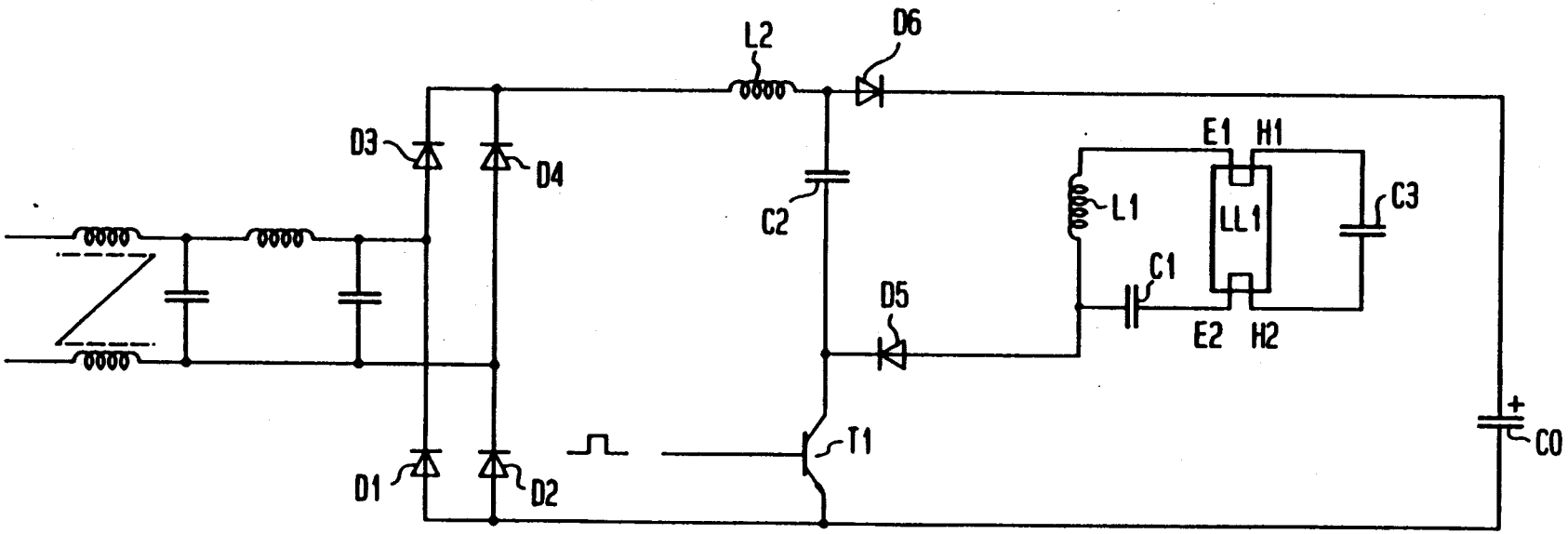
FIG. 2 is a circuit diagram of a supply circuit including a heating capacitor and a harmonic oscillation filter for operating a low-pressure discharge lamp.

FIG. 2 shows the circuit diagram of a supply circuit including the harmonic oscillation filter 3 for operating the low-pressure discharge lamp LL1. At the input of the network the high-frequency filter 1 is located which is followed by the power rectifier 2 in a 2-pulse uncontrolled bridge connection. The single-phase high-frequency generator operated through an electronic control circuitry 6 includes the switching transistor T1, a switching inductance L1 and an oscillating capacitor C1.

Figure 4:
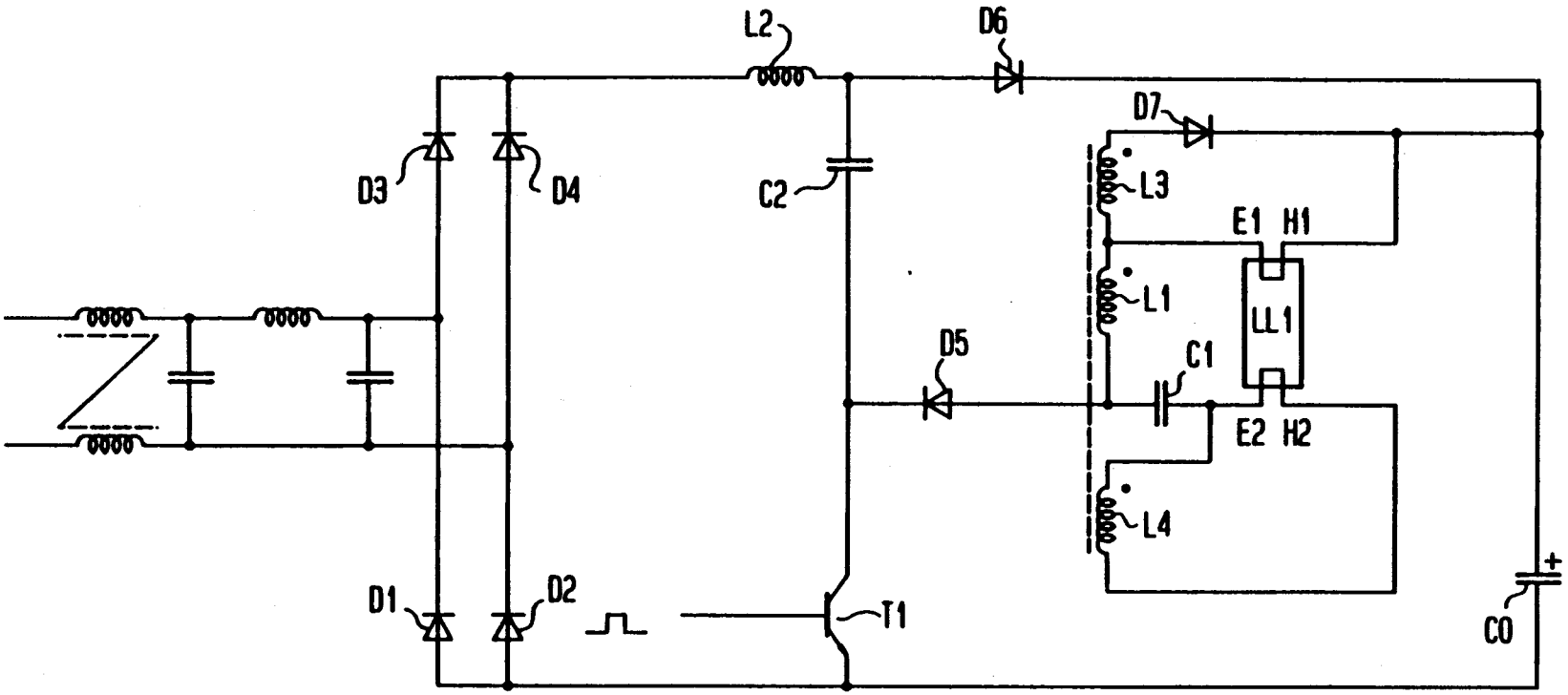
FIG. 4 is a circuit diagram of a supply circuit including a heating winding and a harmonic oscillation filter for operating a low-pressure discharge lamp.

The electrodes of the lamp LL1 are connected to the switching inductance L1 and the filter capacitor C0 with one side E1, H1 and to the oscillating capacitor C1 with the other side E2, H2. The electrodes of the heating circuits H1 and H2 may—as can be seen from FIG. 2—be connected via a heating capacitor C3; or separately—as is shown in FIG. 4—with E1-H1 and E2-H2 one heating winding each can be connected as partial winding of the switching inductance L1.

In case the switching transistor is conducting, the single-phase high frequency generator operated at high frequency delivers through the oscillating capacitor C1 from the positive pole of the filter capacitor C0 a portion of the positive current half-wave of the lamp. At the same time the switching inductance L1 charges an energy portion proportional to the switching-on period of the switching transistor T1. If the switching transistor T1 is switched off, an oscillating circuit comes into existance via lamp, oscillating capacitor C1 and switching inductance L1, said oscillating circuit at first at the same current direction in the switching inductance L1 producing the negative current half-wave of the lamp and thereafter at a reversion of the current direction in the switching inductance L1 by discharging the oscillating capacitor C1 producing the remaining portion of the positive current half-wave in the lamp. The filter capacitor C0 therein is decoupled from the power voltage by the decoupling diode D6.

The supply circuit further includes an active harmonic oscillation filter consisting of the series inductance L2 located in the positive line, the pump capacitor C2 and the decoupling diodes D5 and D6.

The operating mode of the active harmonic oscillation filter in connection with the single-phase lamp generator operated at high frequency will be described in more detail in the following.

When the switching transistor T1 is switched on, the pump capacitor C2 is charged up to the voltage level at the filter capacitor C0 through the series inductance L2. The charging current is taken from the mains. Thus, an energy portion is stored in the series inductance L2, which portion is released to the single-phase high-frequency generator, the lamp and the filter capacitor C0 upon termination of the charging of the pump capacitor C2. The amount of energy per pulse therein is proportional to the voltage time area at the series inductance L2 and is determined by the difference of the power voltage instantaneous values and the voltage at the pump capacitor C2, which voltage is applied in negative polarity due to the preceeding switch-off pulse. The power current is sinusoidally modulated with every lamp pulse by the influence of the power current instantaneous values. The energy output of the series inductance L2 is effected by demagnetizing the series inductance L2. For this purpose the voltage at the series inductance L2 changes polarity and reaches a voltage value equal to the difference from the voltage at the filter capacitor C0 and the respective instantaneous value of the power voltage.

When the switching transistor T1 is switched off, the second phase in the effect of the pump capacitor C2 begins. The current flowing in the switching inductance L1 commutates from the switching transistor T1 partly to the pump capacitor C2 as discharge and swing-over current and for the other part to the oscillating capacitor C1 and the low-pressure discharge lamp which thus receives its negative current half-wave. The pump capacitor thus acts as switch-off discharge network for the switching transistor T1. Thus, the voltage at the collector and/or drain terminal, respectively, of the switching transistor T1 can change only so fast as the pump capacitor C2 is changed in charge with its resonance frequency determined by the capacity of the pump capacitor C2 and the inductance value of the switching inductance L1. By this limitation of the re-increase of the voltage at the switching transistor T1 the switch-off losses thereof are reduced substantially.

The negative current half-wave in the oscillating capacitor C1 and in the low-pressure discharge lamp LL1 is reduced by the current portion which commutates from the switching inductance L1 as reversal current to the pump capacitor C2. Thereby, the peak factor of the lamp current improves and so does the lifespan of the low-pressure discharge lamp.

The electronic control circuitry 6 of the switching transistor consists of an electronic oscillator and a pulse width modulator which can be started and stopped electronically and the pulse width or frequency of which can be adjusted by an electronic control signal. Thereby, an electronic interface can be realized, as is required for various users' options.

Figure 3:
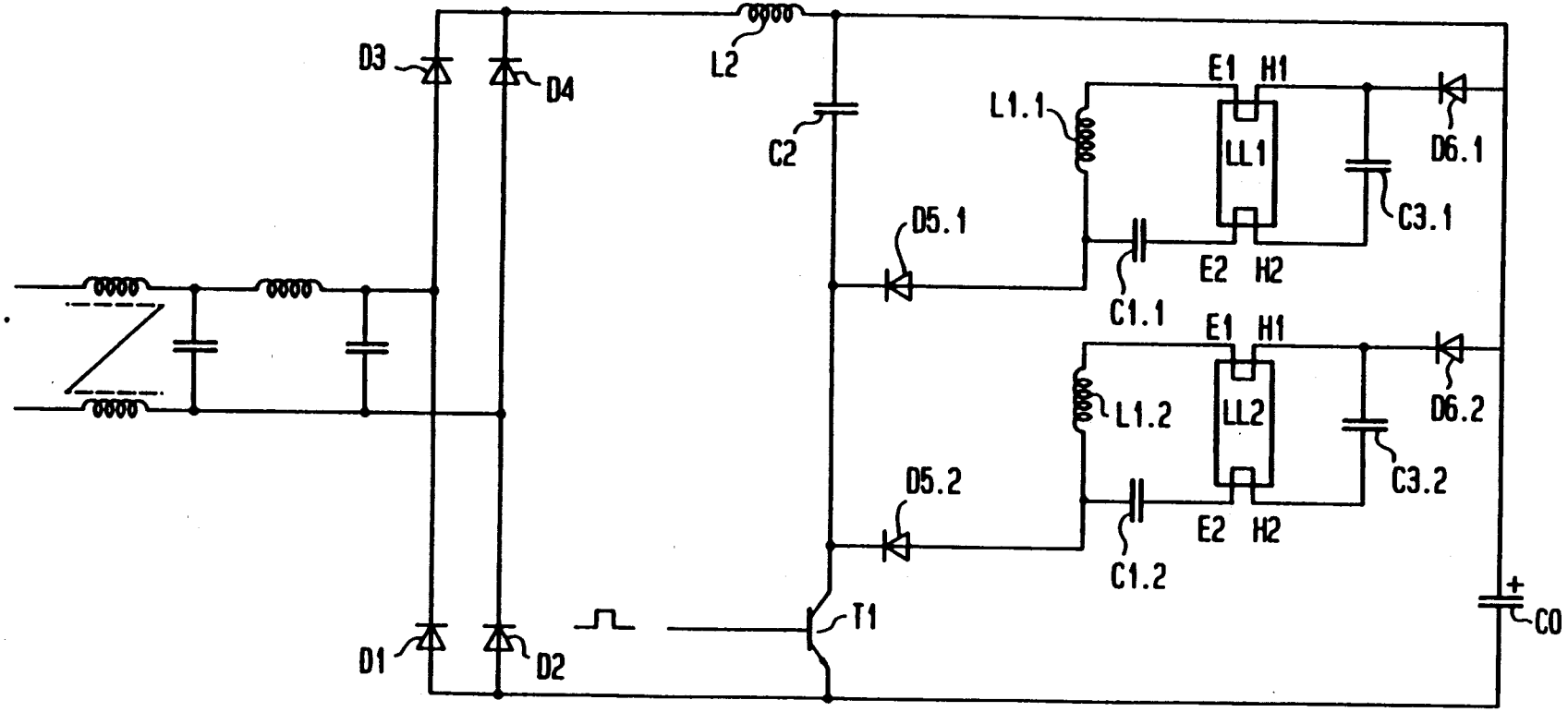
FIG. 3 is a circuit diagram of a supply circuit including a heating capacitor and a harmonic oscillation filter for operation with two low-pressure discharge lamps connected in parallel.

FIG. 3 shows a supply circuit for high-frequency operation of two low-pressure discharge lamps LL1 and LL2 connected in parallel. The portion of the supply circuit correlated to the low-pressure discharge lamp LL1 comprises decoupling diodes D5.1 and D6.1, a switching inductance L1.1, an oscillating capacitor C1.1 and the heating capacitor C3.1. The portion of the supply circuit correlated to the low-pessure discharge lamp LL2 includes decoupling diodes D5.2 and D6.2, a switching inductance L1.2, an oscillating capacitor C1.2 and a heating capacitor C3.2.

FIG. 4 shows a modified embodiment of the circuitry of FIG. 2. For heating the low-pressure discharge lamp LL1 two heating winding sections L3, L4 are provided which are disposed one between the terminals E1 and H1 and the other between the terminals E2 and H2, respectively, of the low-pressure discharge lamp LL1. In this supply circuit the current path in case of inserted low-pressure discharge lamp LL1 leads from the diode D6 via the terminals H1 and E1 of the low-pressure discharge lamp LL1, the switching inductance L1 and the diode D5 to the switching transistor T1. If the low-pressure discharge lamp LL1 were removed from the supply circuit, on one hand the path E1—H1 would be bridged by the heating winding, whereas on the other hand the energy present at the switching inductance L1 could not be discharged any more. For this reason, a further diode D7 is provided as open-circuit protection, said diode being disposed between the switching inductance L1 and the filter capacitor C0 and interrupting the switch-on current path.

Figure 5:
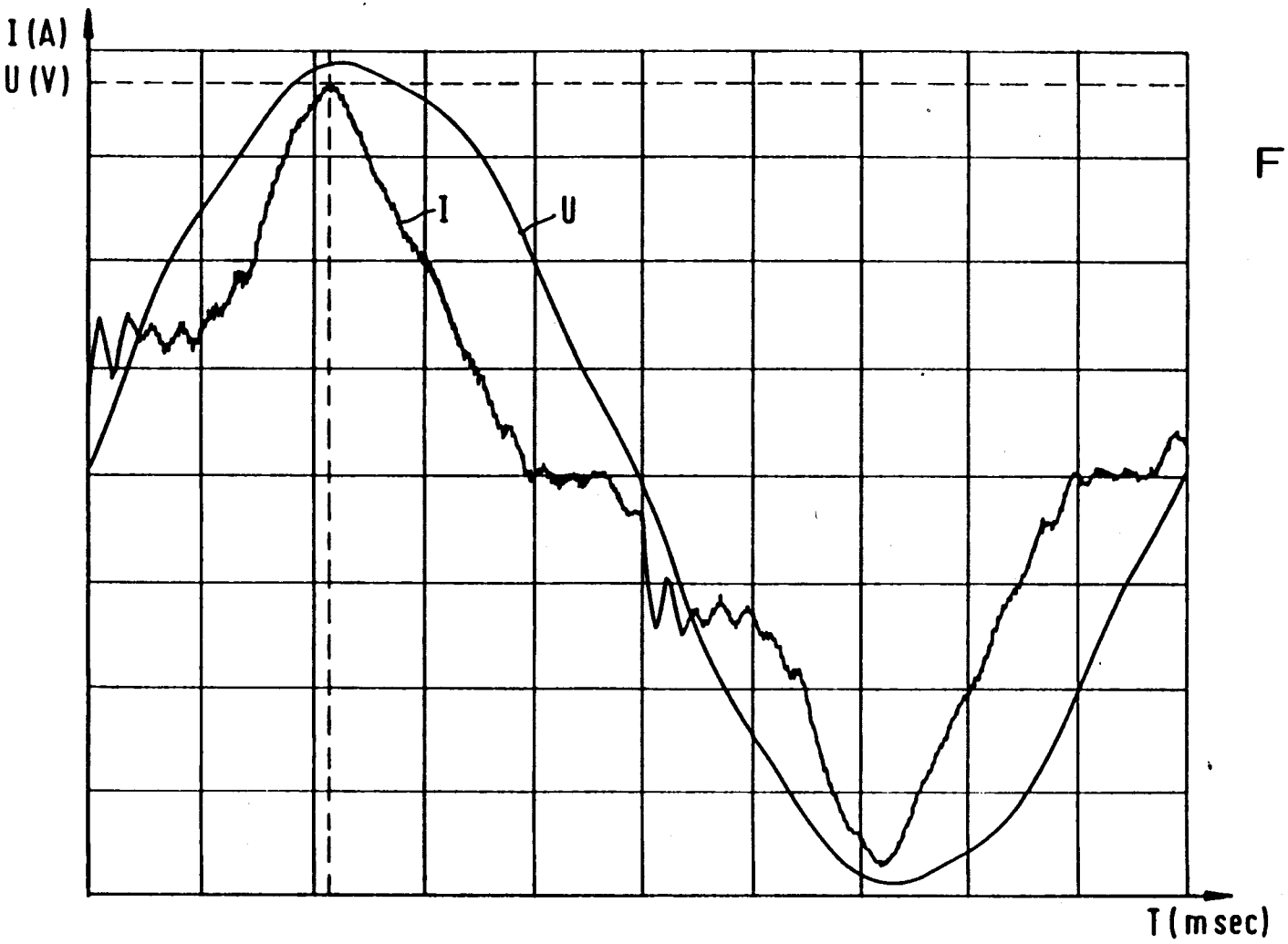
FIG. 5 shows line diagrams for power current and voltage in the supply circuit according to FIG. 2.

FIGS. 5 to 7 show current and voltage diagrams of an actually embodied supply circuit according to FIG. 2.

FIG. 5 is an oscillogram for network voltage and network current of the circuitry according to FIG. 2. The current graph I shows an approximatively sinusoidal course of the network current. Without the harmonic oscillation filter being included in the circuitry of FIG. 2, a current will flow during 1/10 to 1/15 of the half-wave. Such a current peak would cause severe effects in the network, such effects having to be avoided or restricted in order to comply with legal regulations. Due to the harmonic oscillation filter the maximum of the current is decreased and the current will be distributed over the entire half-wave so that the desired approximation of a sinusoidal current curve will result.

Figure 6A:
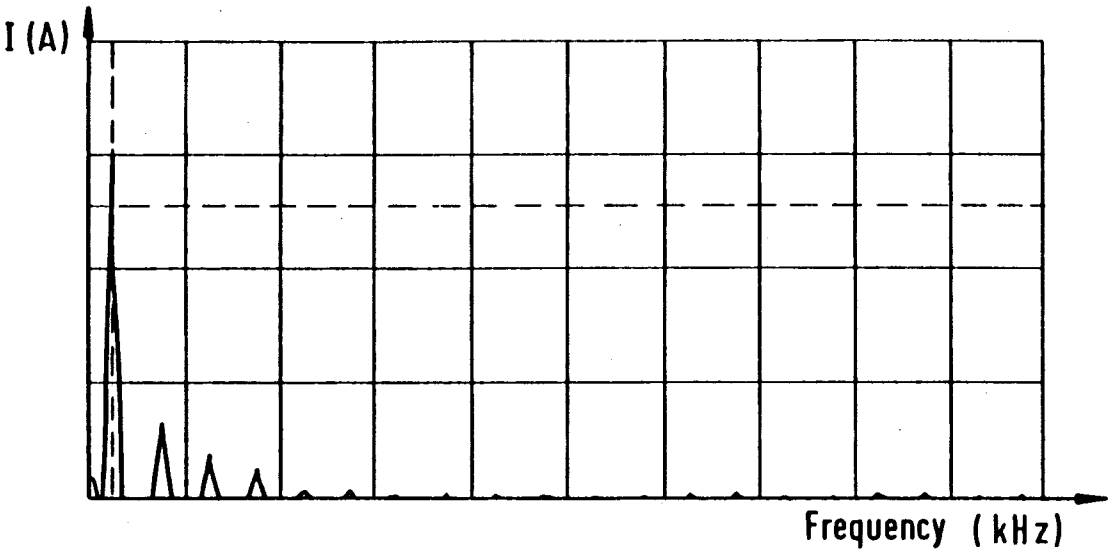
FIGS. 6A and 6B show the harmonic analysis of the power current.
Figure 6B:
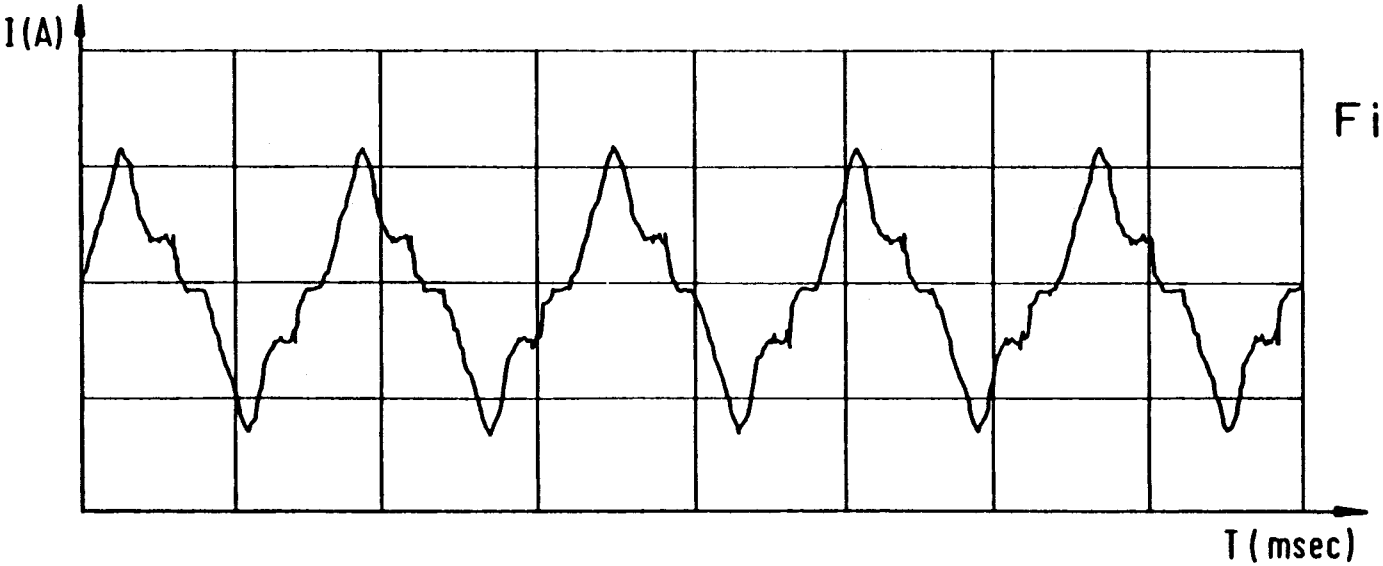

FIG. 6A shows the harmonic analysis of the network current shown in FIG. 5, while FIG. 6B shows a time domain representation thereof. The harmonic oscillation portion of the network current therein lies substantially below the threshold values admitted by the VDE (Association of German Electrotechnical Engineers) and the IEC (International Electronical Commission).

Figures 7A, 7B:
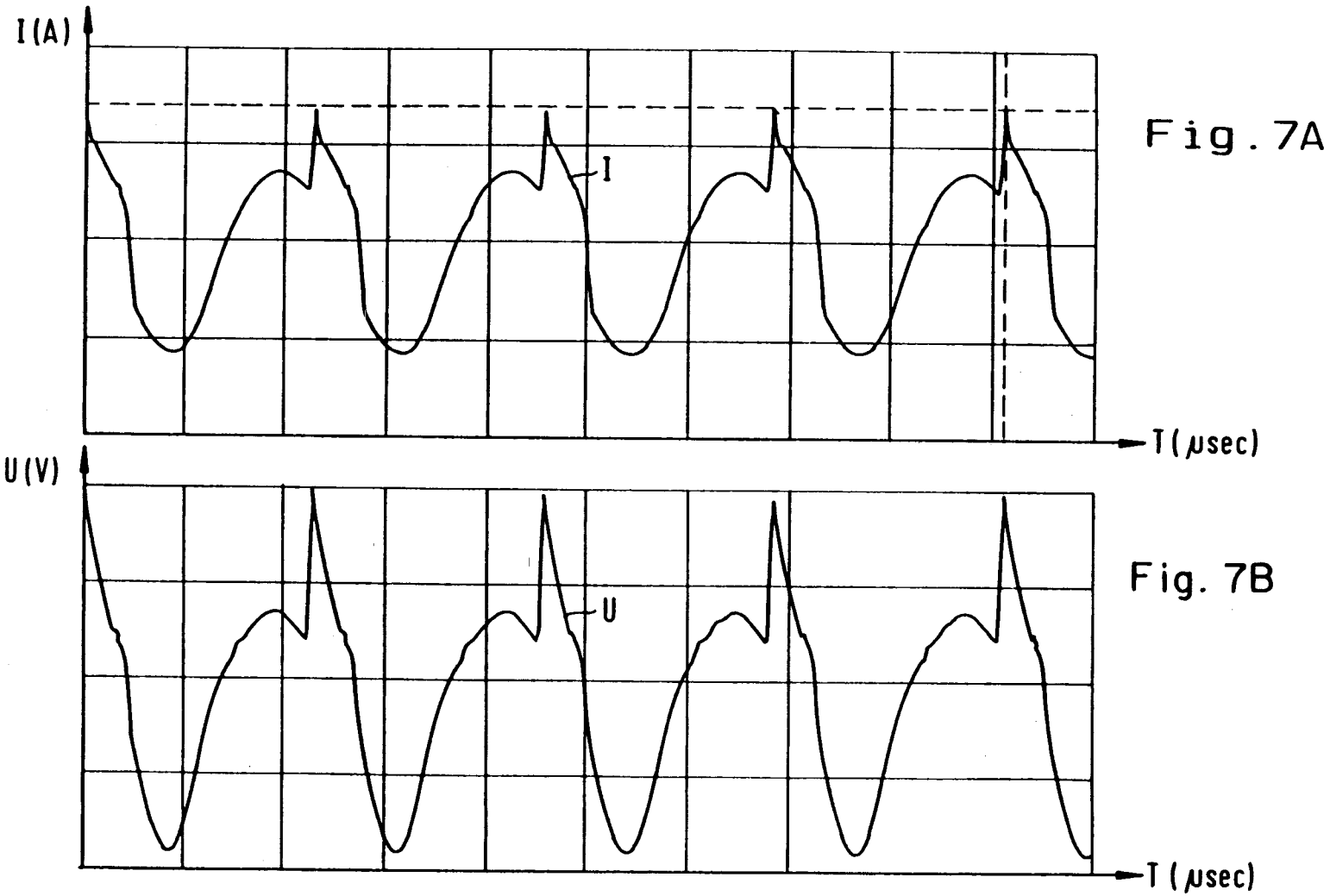
FIGS. 7A and 7B show the lamp current and voltage in the supply circuit according to FIG. 3.

FIGS. 7A and 7B show respectively the lamp current and the lamp voltage of a supply circuit according to FIG. 2. The graphs of the lamp current I and the lamp voltage U each show on the positive half-wave a peak superimposed on a sinusoidal curve. Said peak corresponds to the switch-on period of the transistor T1. In practice it turned out that the low-pressure discharge lamp can be operated with such a current and/or such a voltage, respectively, without detrimental side effects or a shorter lifespan resulting therefrom.

Figure 8:
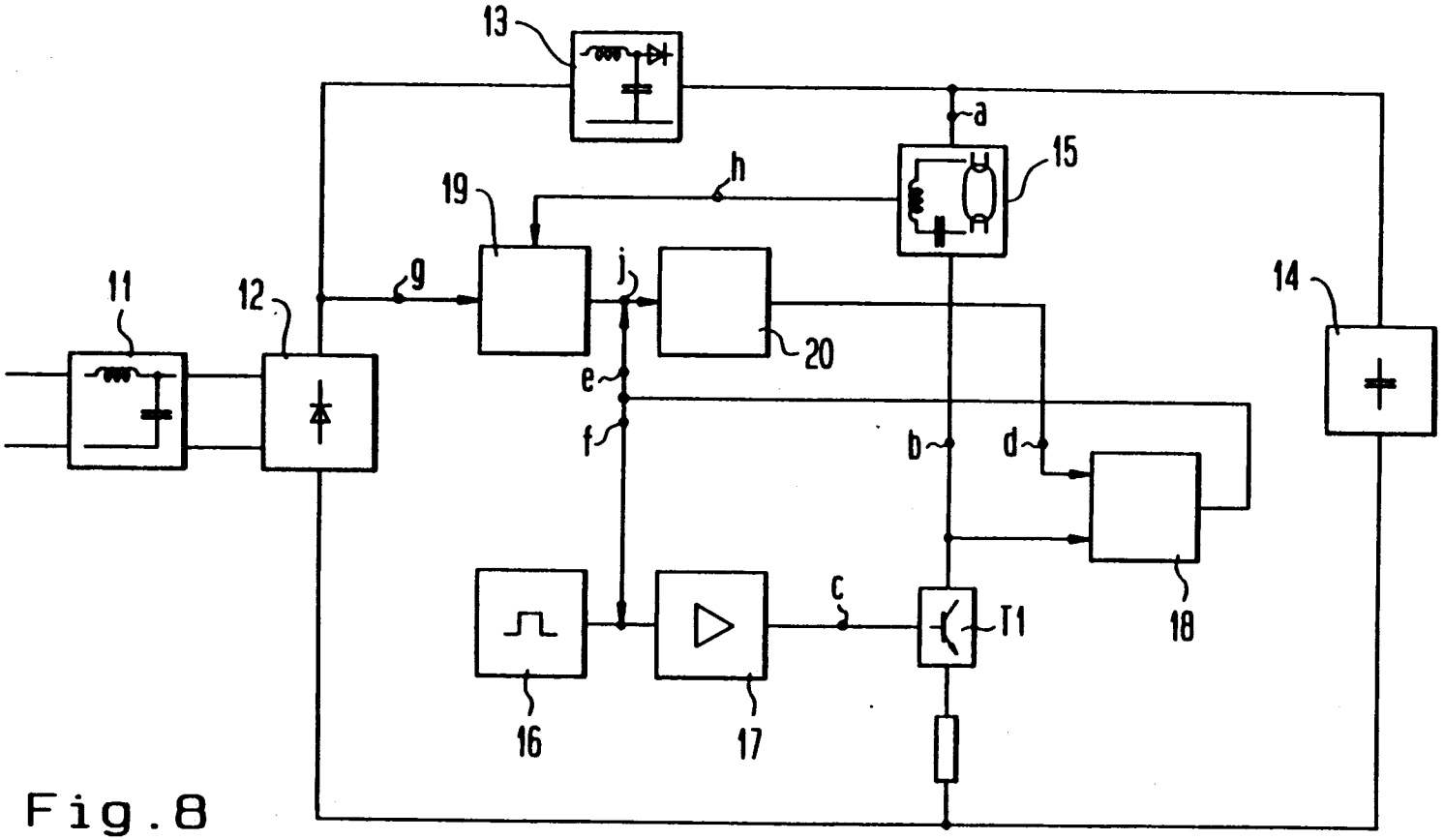
FIG. 8 is a block diagram of a further embodiment of the supply circuit with the individual switching sections.

The block diagram in FIG. 8 respresents the structural principle of a further supply circuit for the high-frequency operation of a low-pressure discharge lamp LL1. The reference letters a–j in FIG. 8 are also to be found in FIGS. 9 to 11 in order to show the connecting points of the different portions of the circuit of FIG. 8.

The supply circuit includes a high-frequency filter 11, a power rectifier 2, an active harmonic oscillation filter 13, a filter capacitor 14, a single-phase high-frequency lamp generator 15, an electronic control system 16, a driver circuit 17, an excess-voltage monitoring system 18, a starting circuit 19 and an electronic supply 20.

Figure 9:
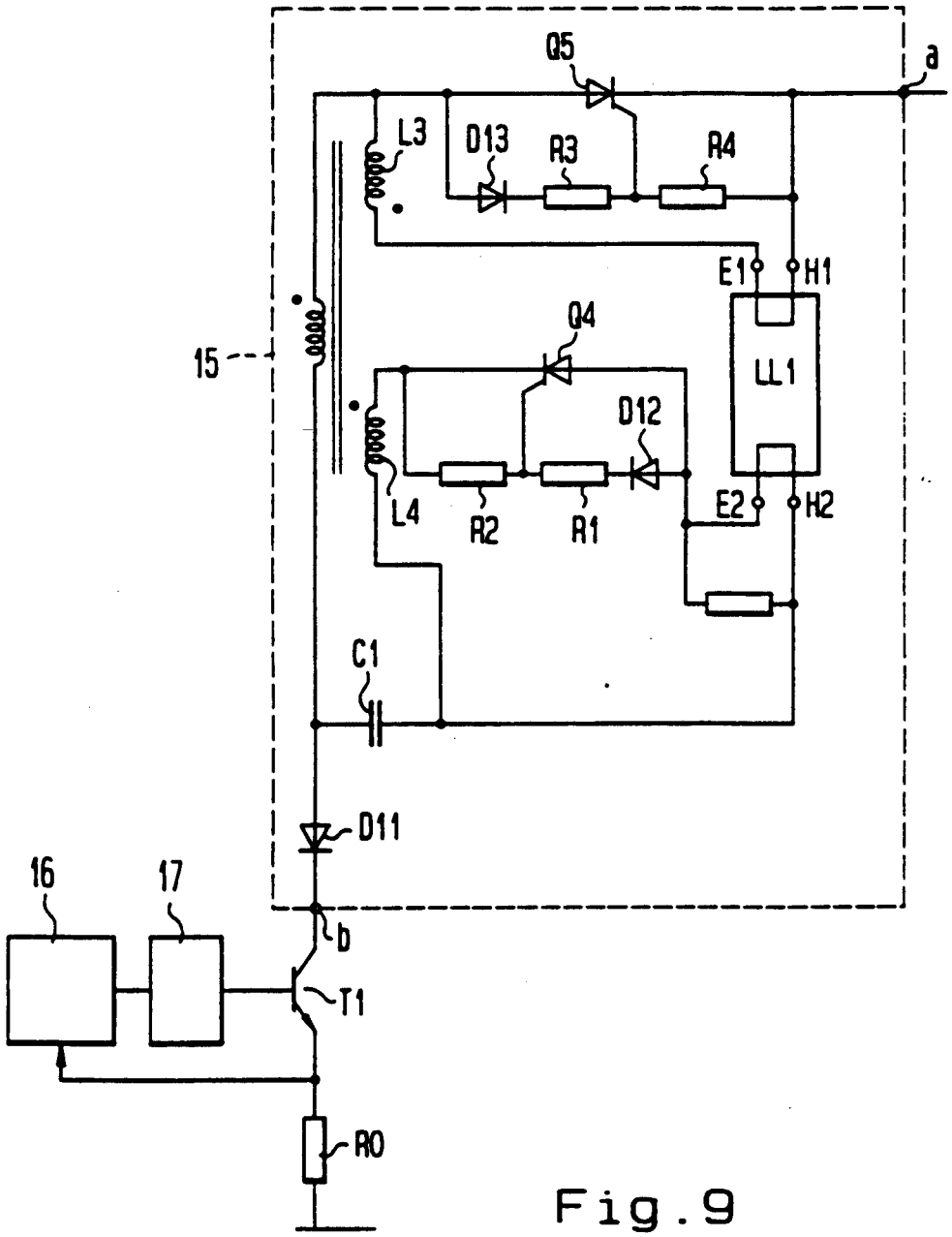
FIG. 9 is a circuit diagram of the supply circuit of the two additional secondary heating windings with thyristor pick-up connection on the heating coils and the excess current detection.

FIG. 9 shows the circuit diagram of the supply circuit with two additional secondary heating windings L3 and L4 which are switched with thyristors Q5 and Q4 to the heating coils E1, H1 and E2, H2. The secondary heating windings L3 and L4 are switched in dependance on the operating condition of the lamp. A lamp not yet having been ignited or just being started shows an increased operating and ignition voltage which is at disposal as secondary voltage also at the windings L3 and L4 and is used as trigger voltage. The ignition point for the thyristors Q4 and Q5 is determined by voltage dividers embodied by resistors R1, R2 and resistors R3, R4.

If the lamp is operated with nominal operating voltage, the trigger voltage will not be reached, so that the heating therefor remains switched off continuously. When the operating voltage of the lamp increases, e.g. at low operating temperatures or at dimmed lamp, the trigger voltage is reached, whereby the heating of the coils is switched on automatically. If the heating coils are switched off or the operation thereof is interrupted, diodes D2 and D3 avoid an inadmissibly high current load of the voltage divider resistors.

The starting behavior can be further improved an increasing in the switching frequency of the single-phase high-frequency lamp generator, as every switching cycle provides a heating current pulse. The circuit provides for an increased frequency every time when the electronic feeding voltage is applied to the electronic control circuit 16 for the first time.

FIG. 9 shows the excess-voltage detection of the emitter current of the switching transistor T1 via the potential drop at a resistor R0 connected in series with the emitter of the switching transistor T1. If a given current threshold value is reached, the respective potential drop acts on the electronic control circuit 16 in such way that the driver circuit 17 is switched off and thus the switching transistor T1 is switched off, too. This supply circuit, therefore, acts as electronical excess-current protection.

Figure 10:
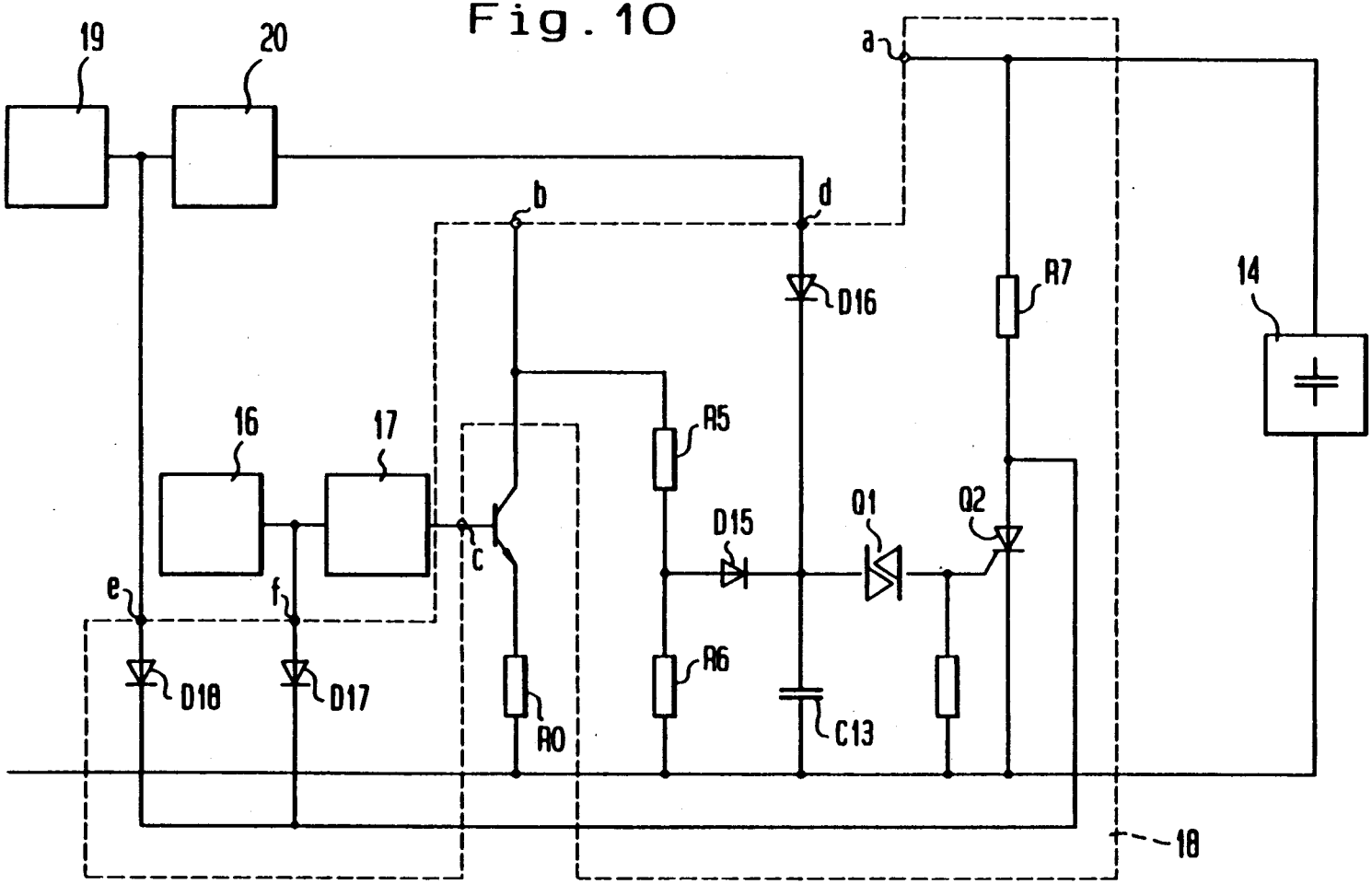
FIG. 10 is a circuit diagram of the supply circuit for detecting an excess voltage in the collector of the switching transistor and in the electronic feeding circuit.

FIG. 10 shows a circuit section of the supply circuit for excess-current detection. The collector voltage of the switching transistor T1 is switched to a trigger diode Q1 via a voltage divider embodied by resistors R5, R6 and the diode D15. Using a logical "OR"-connection the trigger diode Q1 may also be switched via the diode D16 depending on the level of the electronic feeding voltage. A capacitor C3 prevents the trigger circuit from responding to voltage peaks occurring for but short periods of time and upon through-connection of the trigger diode Q1 delivers the ignition current required for a thyristor Q2. If the thyristor Q2 is ignited by means of a trigger pulse, the circuit is self-maintained via the resistor R7.

At the same time it provides a short-circuit connection of the output terminal of the electronic control circuit 16 via a diode D17 and the output terminal of the starting circuit 19 via a diode D18. Thereby the single-phase high-frequency lamp generator is switched off. The lamp can only be started anew after the supply circuit has been separated from the mains supply, i.e. after the self-maintained current of the thyristor Q2 has been terminated.

Figure 11:
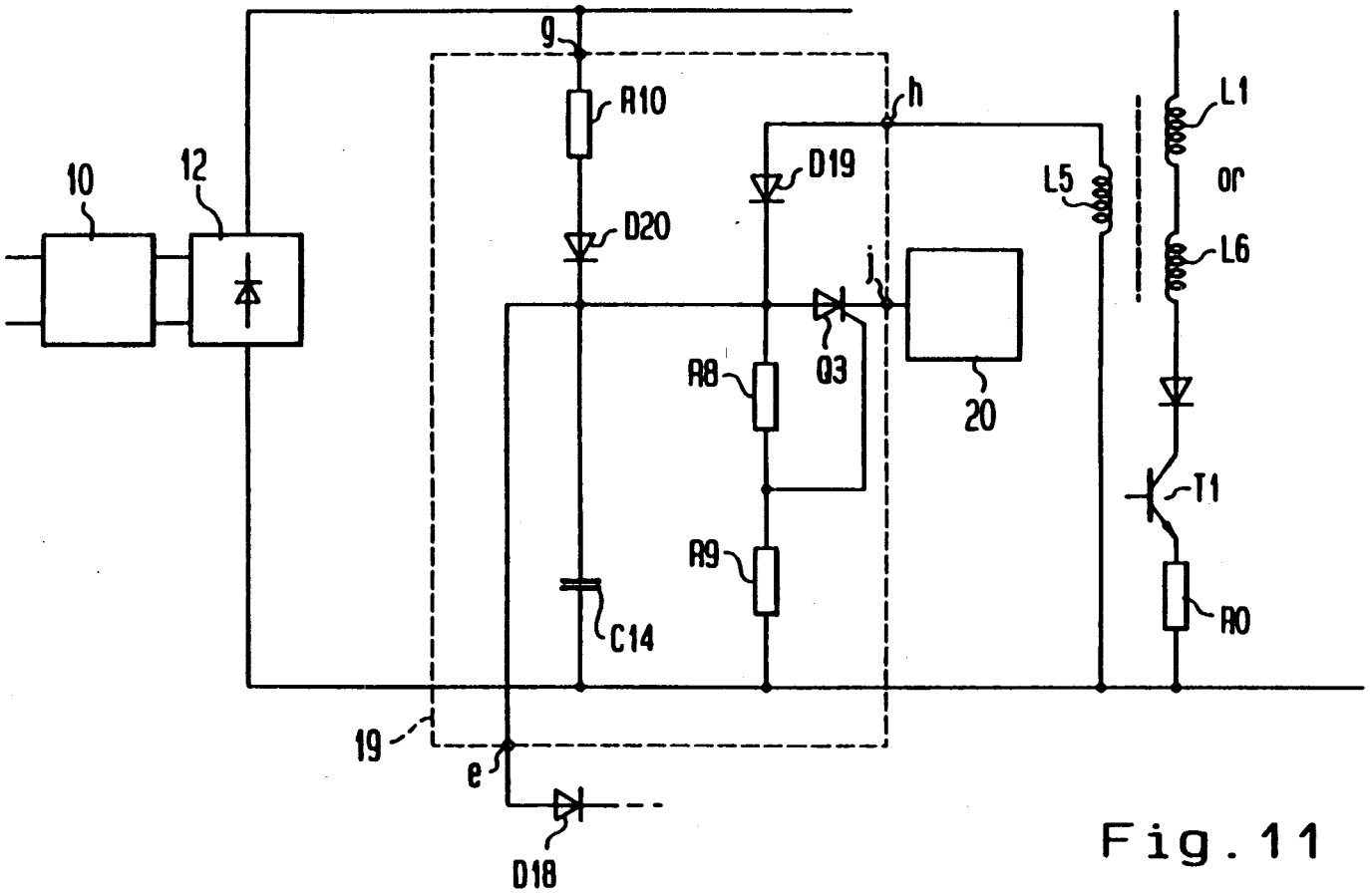
FIG. 11 is a circuit diagram of the supply circuit for generation of feeding voltage.

FIG. 11 shows the circuit section of the supply circuit for the starting circuit 19 and for the electronic feeding circuit 20. Each time the network voltage is switched on, the capacitor C14 is charged via a resistor R10 and a diode D20. A maximum voltage value at the capacitor C14 is given by a voltage divider embodied by resistors R8, R9, at which value the thyristor Q3 switches said voltage to the electronic feeding circuit.

Thereby the single-phase high-frequency lamp generator can start oscillating and can take over the electronic feeding (self-supply) via magnetically coupled coils L1–L5 and/or alternatively L6–L5, respectively, under the blocking oscillator converter principle. The voltage stabilisation is effected in block 20 (FIG. 8) in the most simple way with the aid of a series transistor.

What is claimed:

1. A supply circuit for high-frequency operation of a low-pressure discharge lamp or several low-pressure discharge lamps connected in parallel, wherein the supply circuit comprises a power rectifier followed by:

an active harmonic oscillation filter; and a filter capacitor additional thereto, and a single-phase high-frequency generator comprising a switching transistor, a switching inductance and an oscillating capacitor, said generator being supplied from said filter capacitor and being decoupled from a power supply by two decoupling diodes.

2. A supply circuit as defined in claim 1, wherein said active harmonic oscillation filter comprises a series inductance, a pump capacitor and said two decoupling diodes, whereby current from the power supply is substantially sinusoidal at a frequency corresponding to a switching frequency of said switching transistor and modulated by a lamp discharge pulse.

3. A supply circuit as defined in claim 2, wherein said pump capacitor is connected to a collector or drain terminal, respectively, of the switching transistor and one of said decoupling diodes are connected in parallel to the switching inductance and the other of said decoupling diodes, wherein an increase of the voltage at the switching transistor is predetermined by a resonance characteristic determined by the switching inductance and the pump capacitor.

4. A supply circuit as defined in claim 1, wherein said single-phase high-frequency generator is operated at a resonance frequency determined by the switching inductance and the oscillating capacitor.

5. A supply circuit as defined in claim 2, wherein said pump capacitor is connected through the two decoupling diodes in parallel to the switching inductance.

6. A supply circuit as defined in claim 1, wherein the switching transistor is controlled by an electronic control circuit.

7. A supply circuit as defined in claim 6, wherein an electronic interface is formed by said electronic control circuit.

8. A supply circuit as defined in claim 7, wherein said electronic control circuit comprises an electronic oscillator and a pulse width modulator.

9. A supply circuit as defined in claim 1, wherein said switching inductance has two additional secondary windings, each of which is switchably connected by a respective thyristor to a respective heater coil depending on lamp voltage.

10. A supply circuit as defined in claim 1, wherein with the aid of an electronic control system upon each inital starting of the circuit, the switching frequency of the single-phase high-frequency generator is increased for thereupon being continuously decreased to a nominal pulse frequency within a 1/10-second time period.

11. A supply circuit as defined in claim 1, wherein an excess voltage at a collector or drain terminal of said switching transistor via a voltage divider and one of said decoupling diodes, as well as an excess voltage of an electronic feeding circuit via the other of said decoupling diodes are used for triggering a thyristor via a trigger diode, said thyristor deactivating a starting circuit and a control circuit of said switching transistor.

12. A supply circuit as defined in claim 1, wherein, for protection of the circuit against excess currents, the emitter current of the switching transistor is detected at a resistor as a voltage drop and wherein a signal corresponding to said voltage drop is fed to a control circuit switching off the switching transistor when said voltage drop reaches a predetermined value.

13. A supply circuit as defined in claim 1, wherein, upon applying voltage from the power supply, an initial feeding voltage is built up at a capacitor via a resistor and a diode up to a maximum threshold voltage, and whereupon, thereafter, the voltage built up at said capacitor is switched by a thyristor to an electronic feeding circuit.

14. A supply circuit as defined in claim 1, wherein with each lamp pulse an alternating voltage is tapped by means of a further secondary winding on said switching inductance and is supplied through a rectifier as an electronic self-supply voltage.

15. A supply circuit as defined in claim 1, wherein with each lamp pulse an alternating voltage is tapped by means of a further secondary winding on a protective inductance and is supplied through a rectifier as an electronic self-supply voltage.

* * * * *